US007871238B2

(12) United States Patent
Yoshida et al.

(10) Patent No.: US 7,871,238 B2
(45) Date of Patent: Jan. 18, 2011

(54) FUEL PUMP

(75) Inventors: Shigeru Yoshida, Obu (JP); Satoshi Miura, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 942 days.

(21) Appl. No.: 11/737,959

(22) Filed: Apr. 20, 2007

(65) Prior Publication Data

US 2007/0264117 A1 Nov. 15, 2007

(30) Foreign Application Priority Data

May 9, 2006 (JP) ..... 2006-130209

(51) Int. Cl.
*F04D 29/44* (2006.01)

(52) U.S. Cl. ..... 415/55.2; 415/55.6

(58) Field of Classification Search ..... 415/55.1, 415/55.2, 55.3, 55.4, 55.5, 55.6, 55.7
See application file for complete search history.

(56) References Cited

U.S. PATENT DOCUMENTS 4,653,979 A * 3/1987 Schillinger ..... 415/55.6
4,692,092 A 9/1987 Matsuda et al.
6,152,688 A * 11/2000 Staab et al. ..... 415/55.5
6,471,466 B2 * 10/2002 Marx et al. ..... 415/55.1
6,739,844 B1 * 5/2004 Yu et al. ..... 417/366
6,929,742 B2 * 8/2005 Wehrum et al. ..... 210/257.1
7,473,069 B2 * 1/2009 Deichmann et al. ..... 415/55.6

FOREIGN PATENT DOCUMENTS

DE 102006016531 11/2006
JP 60113088 6/1985
JP 60219495 11/1985

* cited by examiner

*Primary Examiner*—Edward Look
*Assistant Examiner*—Ryan H Ellis
(74) *Attorney, Agent, or Firm*—Dennison, Schultz & MacDonald

(57) ABSTRACT

A vapor lock in a fuel pump can be prevented by reducing the formation of vapor within the fuel. A first group of concavities may be formed in an inner circumferential region of an intake side face of an impeller, and a second group of concavities may be formed concentrically in a region outside of the first group of concavities. A third group of concavities that communicates with the second group of concavities may be formed in a discharge side face of the impeller. The impeller is housed within a casing. A first groove that faces the first group of concavities and a second groove that faces the second group of concavities may be formed in the face of the casing that faces the intake side face of the impeller. A third groove that faces the third group of concavities may be formed in the face of the casing that faces the discharge side face of the impeller.

7 Claims, 6 Drawing Sheets

FUEL PUMP

CROSS-REFERENCE TO RELATED APPLICATION

This application claims priority to Japanese Patent Application No. 2006-130209 filed on May 9, 2006, the contents of which are hereby incorporated by reference into the present application.

BACKGROUND OF THE INVENTION

1. Field of the Invention

The present invention relates to a fuel pump that comprises a casing and a substantially disc-shaped impeller rotating within the casing.

2. Description of the Related Art

Fuel pumps that function as devices for supplying fuel within a fuel tank to an internal combustion engine (e.g., the engine of an automobile) are known to the art. This type of fuel pump usually comprises a motor portion and a pump portion. The pump portion comprises a casing and a substantially disc-shaped impeller housed so as to be capable of rotating within the casing. A first group of concavities is formed in a ring shape in the intake side face of the impeller. The first group of concavities is formed concentrically with the impeller along an outer peripheral portion of this impeller. A second group of concavities is formed in the discharge side face of the impeller at a position corresponding to the first group of concavities formed at the intake side. The first group of concavities in the intake side face of the impeller communicates with the second group of concavities formed in the discharge side face thereof.

A first groove is formed in an inner face of the casing that faces the intake side face of the impeller. The first groove is formed in an area that faces the area of the impeller in which the first group of concavities is formed. A second groove is formed in an inner face of the casing that faces the discharge side face of the impeller. The second groove is formed in an area that faces the area of the impeller in which the second group of concavities is formed. The grooves extend along the direction of rotation of the impeller from upper flow ends to lower flow ends, respectively. The upper flow end of the first groove at the intake side communicates with the fuel tank via an intake hole. The lower flow end of the second groove at the discharge side communicates with the motor portion via a discharge hole.

In this fuel pump, fuel is drawn into the casing through the intake hole when the impeller rotates. The fuel that has been drawn in is led along the groups of concavities of the impeller and the grooves. The rotation of the impeller exerts a centrifugal force upon the fuel that has been drawn into the casing. The centrifugal force of the impeller increases the pressure of the fuel that has been drawn into the casing while this fuel flows downstream along the grooves. The fuel that has reached the lower flow end of the second groove is discharged to the exterior of the casing from the discharge hole.

In this type of fuel pump, the fuel that has been drawn into the casing is violently agitated by the concavities, and consequently the velocity of the fuel increases abruptly while the pressure thereof falls abruptly. Vapor forms within the fuel when the pressure of the fuel falls. In particular, when the air temperature increases the saturated vapor pressure increases, and consequently, vapor can readily form. The formation of a large amount of vapor within the fuel can cause a vapor lock. The performance of the fuel pump is thereby reduced. A fuel pump capable of effectively preventing vapor locks has been proposed to deal with this problem (e.g., Japanese Laid-open Patent Publications No. 60-113088 and No. 60-219495).

This known fuel pump comprises a first impeller, and a vapor-separating impeller that has a narrow diameter and that is disposed at the upper flow side from the first impeller. The two impellers are coaxial. Any abrupt change in the pressure of the fuel is reduced by the fuel being drawn in by the vapor-separating impeller. The formation of vapor is thus reduced. Furthermore, the centrifugal force generated by the rotation of the vapor-separating impeller causes the fuel to flow toward the outer circumferential region thereof while the vapor that formed when the fuel was being drawn in collects at an inner circumferential region thereof. The fuel and the vapor are thus separated. The separated vapor is transported toward a vapor jet formed in a region inwards from a fuel discharge passage in the radial direction. A vapor lock can be prevented by removing the vapor from the fuel in this manner.

BRIEF SUMMARY OF THE INVENTION

In this known fuel pump, by providing this narrow-diameter impeller for separating the vapor, any abrupt change in the pressure of the fuel can be reduced to a certain extent compared to the case where the fuel is drawn directly into a wide-diameter impeller. However, since the change in the pressure of the fuel is insufficiently reduced, a large amount of vapor may be formed. In this case, it is difficult to completely separate the vapor and the fuel, and consequently vapor remains within the fuel. The vapor remaining within the fuel may flow into a later stage of the impeller and cause a vapor lock. Pump efficiency thus is decreased.

It is, accordingly, one object of the present teachings to provide a fuel pump capable of preventing a vapor lock by reducing the formation of vapor within the fuel.

In one aspect of the present teachings, a fuel pump may comprise a casing and a substantially disc-shaped impeller rotating within the casing. A first group of concavities and a second group of concavities are formed in a concentric pattern in an intake side face of the impeller, and the second group of concavities is located outside of the first group of concavities in a radial direction. A third group of concavities is formed in a discharge side face of the impeller, and the third group of concavities communicates with the second group of concavities. A first groove, a second groove and a communicating groove are formed in an inner face of the casing facing the intake side face of the impeller, the first groove extending continuously in the direction of rotation of the impeller from an upper flow end to a lower flow end in an area facing the first group of concavities, the second groove extending continuously in the direction of rotation of the impeller from an upper flow end to a lower flow end in an area facing the second group of concavities, and the communicating groove communicating with the lower flow end of the first groove and with the upper flow end of the second groove. A third groove is formed in an inner face of the casing facing the discharge side face of the impeller, this third groove extending continuously in the direction of rotation of the impeller from an upper flow end to a lower flow end in an area facing the third group of concavities.

In this fuel pump, when the impeller rotates fuel is first drawn into the upper flow end of the first groove formed at the intake side of the impeller. Due to the rotation of the impeller, the pressure of the fuel that has been drawn into the upper flow end of the first groove increases as the fuel flows from the upper flow end to the lower flow end of the first groove. The fuel that has increased in pressure while in the first groove is supplied to the upper flow end of the second groove via the communicating groove. The pressure of the fuel that has been supplied to the upper flow end of the second groove increases as the fuel flows from the upper flow end to the lower flow end of the second groove. Simultaneously, the fuel that has been supplied to the upper flow end of the second groove is also led to the third groove formed at the discharge side of the impeller. The pressure of the fuel that has been supplied to the upper flow end of the third groove increases as the fuel flows from the upper flow end to the lower flow end of the third groove. The fuel that has increase in pressure is discharged to the exterior of the casing from the lower flow end of the third groove.

In this fuel pump, the fuel drawn into the casing is first pressurized only by the first groove and the first group of concavities formed at the intake side of the impeller. It is consequently possible to prevent the fuel from being drawn into the casing abruptly. Furthermore, the fuel that has been drawn into the first groove is agitated only by the first group of concavities. As a result, the fuel is agitated only to a small extent. It is consequently possible to reduce any abrupt change in the pressure of the fuel drawn into the casing. The formation of vapor in the fuel can consequently be reduced effectively. The amount of vapor contained in the fuel in the second and third grooves is thus reduced, and pump efficiency can thus be improved.

It may be preferred that an escape groove is formed in an inner face of the casing facing the discharge side face of the impeller, a first end of the escape groove facing the lower flow end of the first groove, a second end of the escape groove being connected to the upper flow end of the third groove, and the escape groove extending in a manner corresponding to the communicating groove.

In this fuel pump, the force generated by the fuel flowing along the communicating groove and the force generated by the fuel being led into the escape groove from the upper flow end of the third groove are exerted on the impeller. Balance between the forces that are exerted on the impeller is thus achieved. Contact between the impeller and the casing is thereby prevented.

It may be preferred that the cross-sectional area of the escape groove gradually expands as it proceeds from the first end to the second end.

In this fuel pump, the fuel that has been led from the second groove into the third groove can easily be led into the escape groove.

It may be preferred that the cross-sectional area of the communicating groove gradually contracts as it proceeds from the lower flow end of the first groove to the upper flow end of the second groove.

In this fuel pump, the fuel that has increased in pressure in the first groove is led smoothly into the second groove. Pulsation of the fuel due to an abrupt change in the pressure is thus controlled, and noise can consequently be reduced.

It may be preferred that a vapor jet is formed in the casing, the vapor jet extending from the first groove and/or the communicating groove to the exterior of the casing.

In this fuel pump, vapor from the fuel that has increased in pressure in the first groove is discharged through the vapor jet. The vapor is thus prevented from flowing into the second groove.

In another aspect of the present teachings, a fuel pump may comprise a casing, a first impeller rotatably disposed within the casing, and a second impeller rotatably disposed within the casing. A first group of concavities is formed in only the intake side face of the first impeller, and the first group of concavities is formed in an area located a first distance away from a rotational axis of the first impeller in the radial direction. A second group of concavities is formed in the intake side face of the second impeller, a third group of concavities is formed in the discharge side face of the second impeller, the second group of concavities communicating with the third group of concavities, and the second and third groups of concavities are formed in an area located a second distance away from a rotational axis of the second impeller in a radial direction, the second distance being longer than the first distance. A first groove is formed in an inner face of the casing facing the intake side face of the impeller and extends continuously from an upper flow end to a lower flow end in the area facing the first group of concavities. A second groove is formed in an inner face of the casing facing the intake side face of the impeller and extending continuously from an upper flow end to a lower flow end in the area facing the second group of concavities. A third groove is formed in an inner face of the casing facing the discharge side face of the impeller and extending continuously from an upper flow end to a lower flow end in an area facing the third group of concavities. A communicating passage is formed in the casing and communicates with the lower flow end of the first groove and with the upper flow end of the second groove.

In this fuel pump, also, the abrupt change in the pressure of the fuel drawn into the casing can be reduced, and the formation of vapor in the fuel can be reduced.

These aspects and features may be utilized singularly or in combination in order to make an improved fuel pump. In addition, other objects, features and advantages of the present teachings will be readily understood after reading the following detailed description together with the accompanying drawings and claims. Of course, the additional features and aspects disclosed herein also may be utilized singularly or, in combination with the above-described aspect and features.

DETAILED DESCRIPTION OF THE INVENTION

First, important features of the art set forth in the embodiment will be listed below.

(Feature 1) An intake port and a discharge port are formed in a casing. The intake hole is connected with an upper flow end of a first groove, and the discharge hole is connected with a lower flow end of a third groove. Suction of the fuel into the casing is performed by a first group of concavities.

(Feature 2) The first groove is formed in the same plane as a second groove and a communicating groove. The grooves are thus formed in a spiral shape in an inner face of the casing facing an intake face of the impeller.

Embodiments

An embodiment according to the present teachings is described below with reference to figures. First, the mechanical configuration of a fuel pump will be described with reference to FIG. 1.

Figure 1:
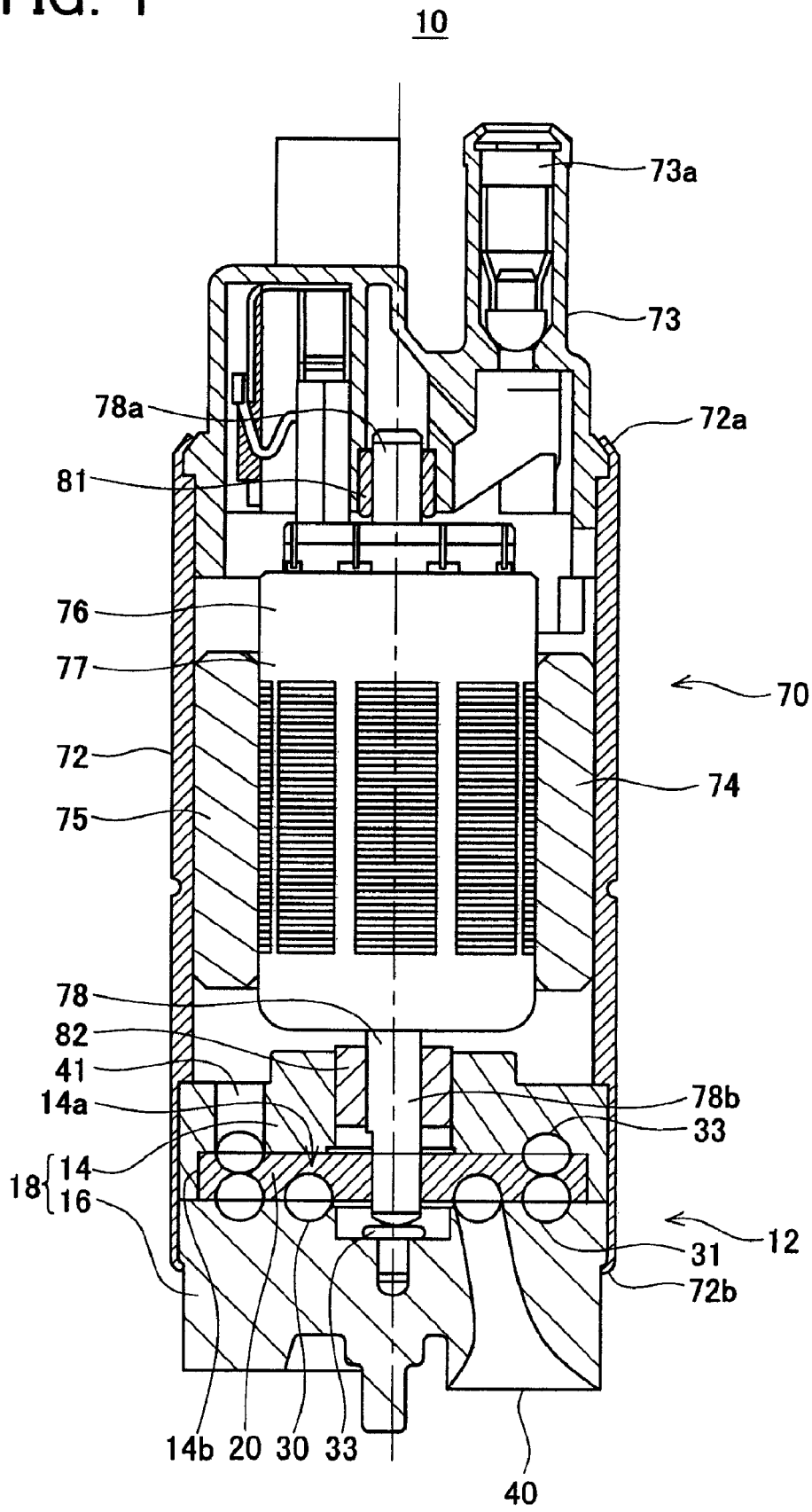
FIG. 1 is a vertical cross-sectional view of a fuel pump of the present embodiment.

As shown in FIG. 1, the fuel pump 10 comprises a motor portion 70 and a pump portion 12.

The motor portion 70 comprises a housing 72, a motor cover 73, magnets 74, 75, and a rotor 76. The housing 72 is formed in a substantially cylindrical shape. The motor cover 73 is attached to the housing 72 by caulking the upper end 72*a* of the housing 72 (hereafter, the up-down direction of FIG. 1 will be considered the up-down direction of the fuel pump 10). A discharge port 73*a* is formed in the motor cover 73. The magnets 74, 75 are fixed to the inner walls of the housing 72. The rotor 76 has a main body 77, and a shaft 78 that vertically extends through the main body 77. An upper end 78*a* of the shaft 78 is rotatably mounted on the motor cover 73 via a bearing 81. A lower end 78*b* of the shaft 78 is rotatably mounted on a pump cover 14 of the pump portion 12 via a bearing 82. Since the motor portion 70 is the same as motor portions taught in Japanese Laid-open Patent Publications No. 60-113088 and No. 60-219495, a more detailed description thereof is omitted.

Figure 2:
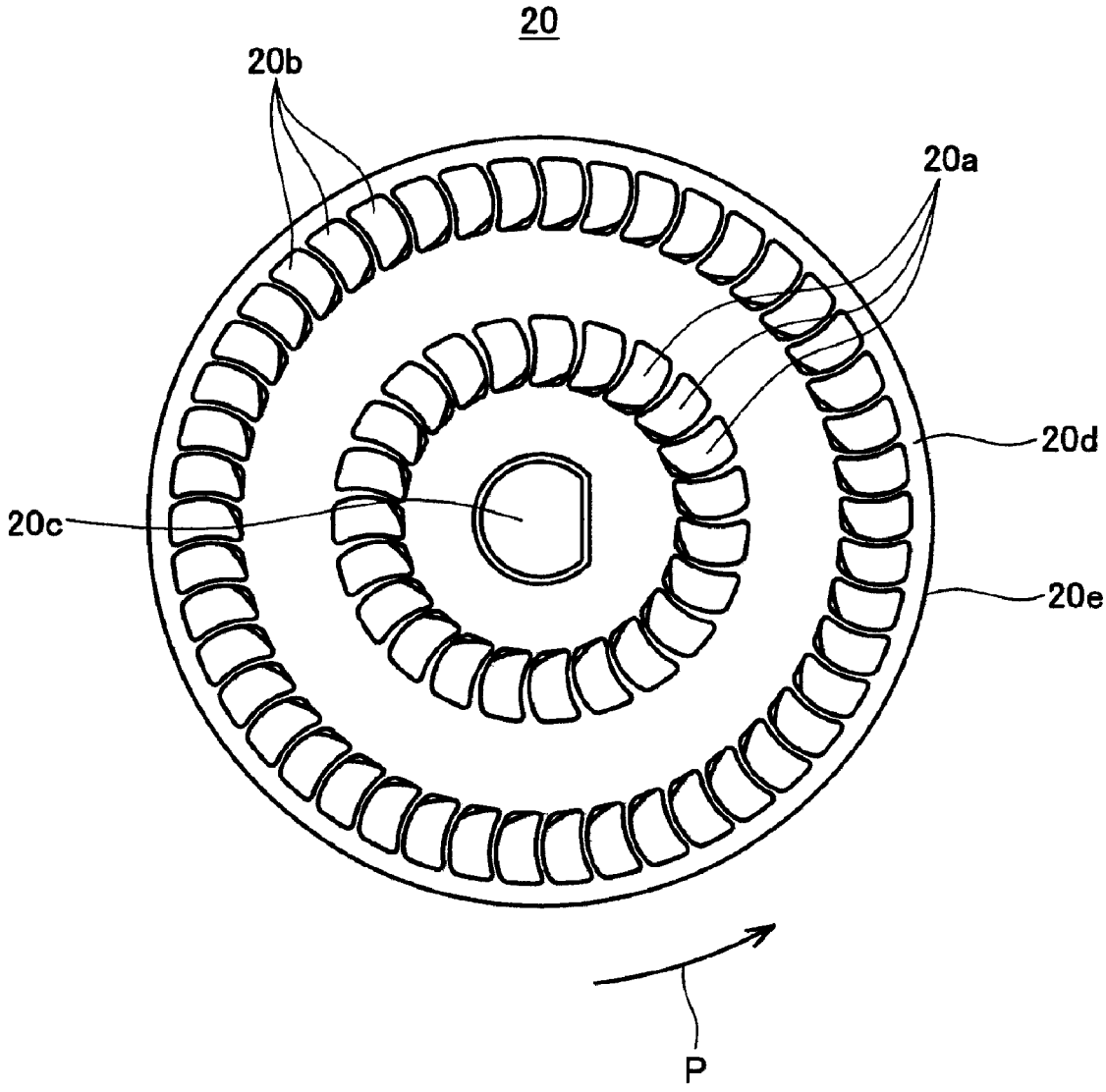
FIG. 2 is a plan view of an impeller of the present embodiment seen from an intake side.
Figure 3:
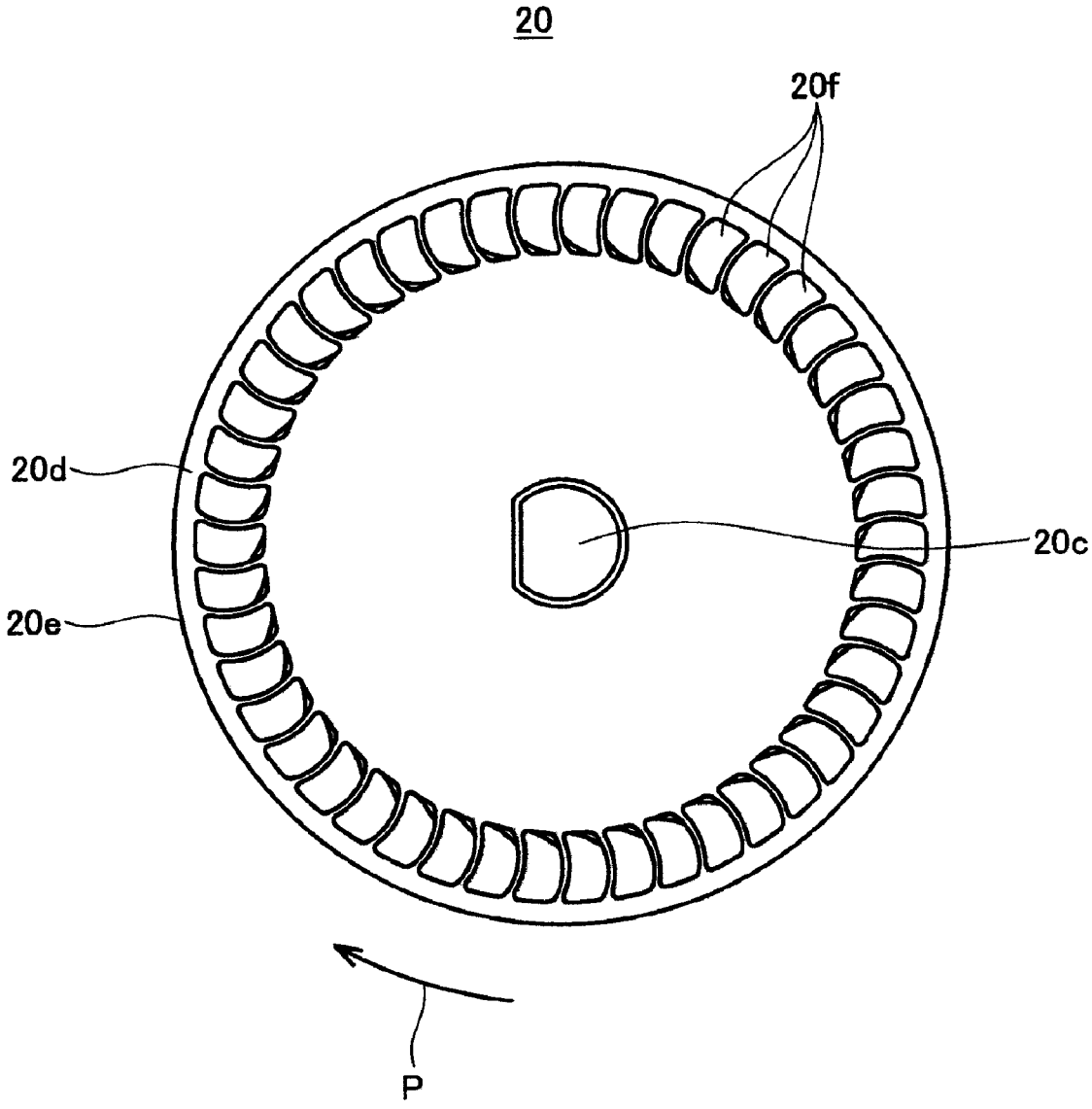
FIG. 3 is a plan view of the impeller of the present embodiment seen from a discharge side.

The pump portion 12 comprises a casing 18 and a substantially disc-shaped impeller 20. FIG. 2 is a plan view of the intake side of the impeller 20. FIG. 3 is a plan view of the discharge side of the impeller 20.

As shown in FIG. 2, a second group of concavities 20*b* that is formed continuously in the circumferential direction is disposed in a ring shape along an outer peripheral portion of the intake side face of the impeller 20 (not all concavities of the second group have been numbered in FIG. 2). The second group of concavities 20*b* is separated from the outer peripheral face 20*e* of the impeller 20 by the outer peripheral wall 20*d* of the impeller 20. A first group of concavities 20*a* that is formed continuously in the circumferential direction is disposed in a ring shape inwards from the second group of concavities 20*b* in the radial direction (not all concavities of the first group have been numbered in FIG. 2). Each concavity of the first group of concavities 20*a* are separated by a predetermined space from the second group of concavities 20*b*, and are disposed at a constant distance from a center of the impeller 20. An engaging hole 20*c*, that is substantially D-shaped in cross-section across a plane perpendicular to a rotational axis of the impeller 20, passes through a central portion of the impeller 20 in the direction of the thickness thereof. The shaft 78 engages with the engaging hole 20*c*. The shaft 78 rotates when current supplies to a coil of the main body 77, and the impeller 20 is rotated thereby.

As shown in FIG. 3, a third group of concavities 20*f* that is formed continuously in the circumferential direction is disposed in a ring shape along an outer peripheral portion of the discharge side face of the impeller 20 in a position corresponding to the second group of concavities 20*b* formed in the intake side face of the impeller 20 (not all concavities of the third group have been numbered in FIG. 3). Base portions of each of the second group of concavities 20*b* and the third group of concavities 20*f* communicate via a communicating hole (not shown).

The casing 18 comprises the pump cover 14 and a pump body 16. As shown in FIG. 1, a recess 14*a* is formed in the surface on the impeller side of the pump cover 14 (i.e., the lower surface). The diameter of the recess 14*a* is approximately the same as the diameter of the impeller 20. The recess 14*a* has approximately the same depth as the thickness of the impeller 20. The impeller 20 is rotatably inserted into the recess 14*a*.

An extremely small clearance is formed between the outer peripheral face 20*e* of the impeller 20 and a side face 14*b* of the recess 14*a* of the pump cover 14. This clearance is provided to allow the impeller 20 to rotate smoothly.

The casing 18 with the impeller 20 installed in the recess 14*a* of the pump cover 14 is fixed to the housing 72 by caulking the lower end 72*b* of the housing 72. The lower end 78*b* of the shaft 78 is press fit into the fitting hole 20*c* of the impeller 20, with that portion thereof being further downward from the portion supported by the bearing 82. A thrust bearing 33 that receives the thrust load of the rotor 76 is interposed between the lower end of the shaft 78 and the pump body 16.

Figure 4:
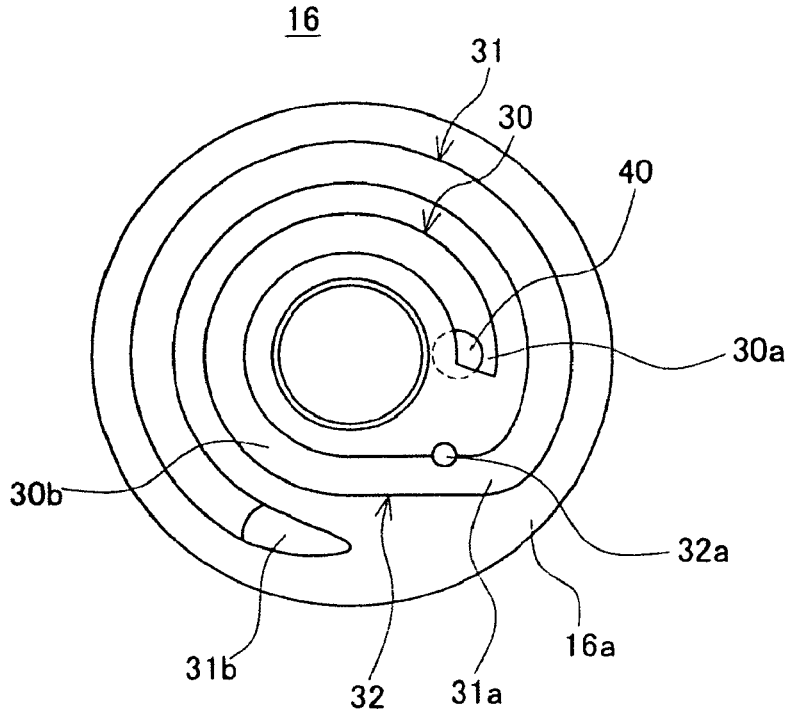
FIG. 4 is a plan view of a pump body of the present embodiment seen from the discharge side.

FIG. 4 is a plan view of the pump body 16 viewed from the impeller 20 side (i.e. viewed from the upper side of FIG. 1). A first groove 30 is formed in an upper face 16*a* of the pump body 16 at the impeller 20 side (i.e. an upper face in FIG. 1). The first groove 30 extends in a circumferential direction in an area facing the first group of concavities 20*a* of the impeller 20. An intake hole 40 is formed at an upper flow end 30*a* of the first groove 30. A second groove 31 is formed in the upper face 16*a* of the pump body 16. The second groove 31 extends in a circumferential direction in an area facing the second group of concavities 20*b*. A lower flow end 30*b* of the first groove 30 and an upper flow end 31*a* of the second groove 31 communicate via a communicating groove 32. The cross-sectional area of the communicating groove 32 gradually contracts as it proceeds from the lower flow end 30*b* of the first groove 30 to the upper flow end 31*a* of the second groove 31. Furthermore, a vapor jet 32*a* that passes through the pump body 16 in the up-down direction (i.e., the up-down direction of FIG. 1) is formed with the communicating groove 32. The function of the vapor jet 32*a* is to remove vapor from fuel.

Figure 5:
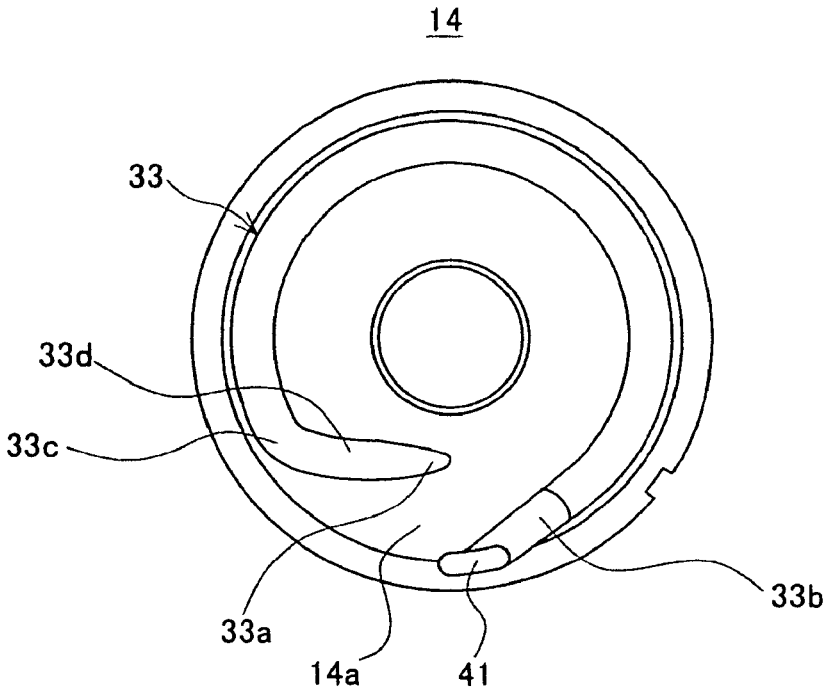
FIG. 5 is a plan view of a pump cover of the present embodiment seen from the intake side.

FIG. 5 is a plan view of the pump cover 14 viewed from the impeller 20 side (i.e. viewed from the lower side of FIG. 1). A third groove 33 is formed in a bottom face of the recess 14*a* of the pump cover 14 (may be referred to below as a lower face of the pump cover). The third groove 33 extends in a circumferential direction in an area facing the third group of concavities 20*f* of the impeller 20. An escape groove 33*d* is formed in the bottom face of the recess 14*a* of the pump cover. The escape groove 33*d* extends from a position 33*c* (hereafter referred to as the lower flow end 33*c*) that corresponds to the upper flow end 31*a* of the second groove 31 to a position 33*a* (hereafter referred to as the beginning end 33*a*) that corresponds to the lower flow end 30*b* of the first groove 30. The cross-sectional area of the escape groove 33*d* gradually expands as it proceeds from the beginning end 33*a* to the lower flow end 33*c*. A discharge hole 41 is formed at the lower flow end 33*b* of the third groove 33. The discharge hole 41 extends from the third groove 33 to an upper face of the pump cover 14 (i.e., the upper face in FIG. 1), and joins the third groove 33 with the exterior of the casing 18.

In the fuel pump 10, when a current flows to the rotor 76 and the impeller 20 rotates, fuel within the fuel tank (not shown) is drawn in through the intake hole 40 into the casing 18. The fuel that has been drawn into the casing 18 initially flows into the upper flow end 30*a* of the first groove 30. The first group of concavities 20*a* is formed only in the intake side of the impeller 20 (at the lower face in FIG. 1). As a result, fuel is not abruptly drawn into the casing 18, and it is possible to draw the fuel into the casing 18 without causing an abrupt change in the pressure of the fuel. The formation of vapor in the fuel can thus be reduced.

The pressure of the fuel that has flowed into the upper flow end 30*a* of the first groove 30 increases in conjunction with the rotation of the impeller 20 while this fuel flows from the upper flow end 30*a* to the lower flow end 30*b* of the first groove 30. The fuel that has flowed into the lower flow end 30*b* of the first groove 30 flows through the communicating groove 32 into the upper flow end 31*a* of the second groove 31. The cross-sectional area of the communicating groove 32 gradually contracts as it proceeds from the lower flow end 30*b* of the first groove 30 to the upper flow end 31*a* of the second groove 31. As a result, the fuel that has increased in pressure in the first groove 30 is prevented from flowing abruptly into the second groove 31. Pulsation of the fuel due to an abrupt change in pressure can consequently be decreased, and noise can consequently be reduced. Furthermore, the vapor that forms in the fuel, as the pressure is increased in the first groove 30, is discharged to the exterior of the fuel pump 10 via the vapor jet 32*a* while the fuel passes through the communicating groove 32. Fuel from which the vapor has been removed consequently flows into the second groove 31, and a vapor lock is thus prevented.

The fuel that has flowed into the second groove 31 increases in pressure as the impeller 20 rotates and as the fuel flows from the upper flow end 31*a* to the lower flow end 31*b* of the second groove 31. Simultaneously, the fuel that has flowed into the second groove 31 also flows from the second group of concavities 20*b* to the third group of concavities 20*f* and the third groove 33. The fuel that has flowed into the third groove 33 increases in pressure as the impeller 20 rotates and as the fuel flows toward the lower flow end 33*b* of the third groove 33. The fuel that has increased in pressure in the third groove 33 is discharged into the interior of the motor portion 70 from the discharge hole 41. The fuel that has been discharged into the motor portion 70 flows through the motor portion 70 and is discharged to the exterior of the fuel pump 10 from the discharge port 73*a* formed in the motor cover 73.

In the fuel pump 10, the fuel within the pump portion 12 increases in pressure due to the rotation of the impeller 20. As a result, the impeller 20 is pushed upward toward the discharge side (i.e., the upper side in FIG. 1) by the fuel in the first groove 30, the communicating groove 32, and the second groove 31 of the pump body 16. Furthermore, the impeller 20 is pushed downward toward the intake side (i.e., the lower side in FIG. 1) by the fuel within the third groove 33 and the escape groove 33*d* of the pump cover 14. The fuel within the pump portion 12 increases in pressure as it flows along the first groove 30, the communicating groove 32, the second groove 31, and the third groove 33. As a result, the fuel flowing along the third groove 33 has the highest pressure. In a conventional fuel pump, i.e. in a fuel pump that has only one groove in both the pump cover 14 and the pump body 16, there was an increase in the pressure pushing the impeller down toward the intake side. There was thus an increase in sliding resistance between the impeller and the pump body, and there was a decrease in pump efficiency. In the fuel pump 10 of the present embodiment, the impeller 20 is pushed upward toward the discharge side by the fuel in the first groove 30, the communicating groove 32, and the second groove 31, and consequently the balance between the pressures exerted upon the impeller 20 in the up-down direction is corrected. Sliding resistance between the impeller 20 and the pump body 16 can consequently be reduced compared to the conventional example.

Furthermore, the escape groove 33*d* is formed so as to correspond to the communicating groove 32 of the pump body 16. Fuel is also led into the escape groove 33*d*. As a result, there is a balance between the pressure of the fuel in the communicating groove 32 and the pressure of the fuel in the escape groove 33*d*, and consequently it is possible to correctly balance, across a plane face, the pressures exerted upon the impeller 20. Inclining of the impeller 20 is thus decreased, and the sliding resistance between the impeller 20 and the pump body 16 can consequently be reduced.

Figure 6:
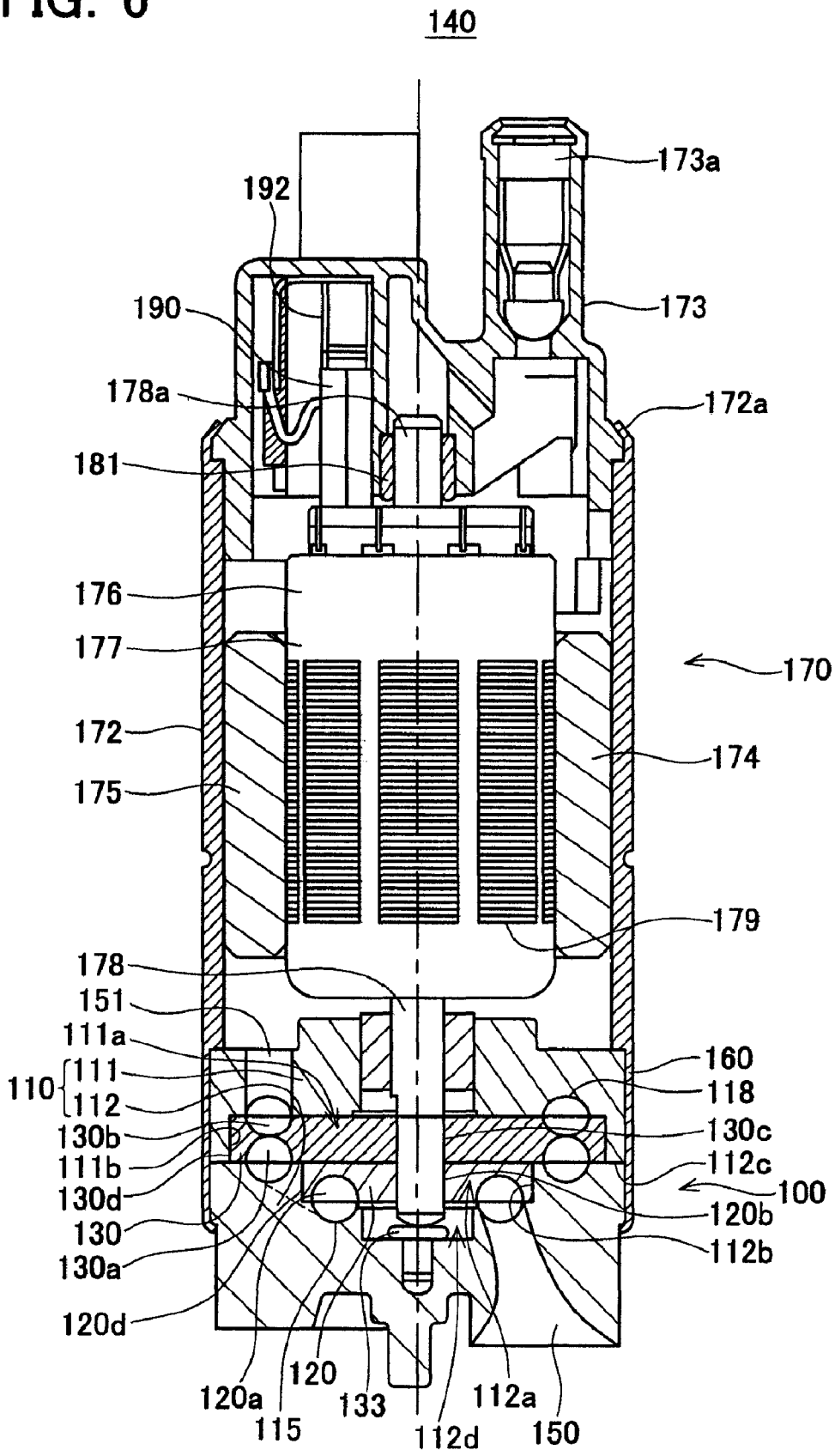
FIG. 6 is a cross-sectional view describing another configuration of a pump portion.

In the fuel pump described above, two groups of concavities are formed in the intake side face of the impeller, forming an upper flow side pump that draws in the fuel, and a lower flow side pump that pressurizes the fuel that has been drawn in by the upper flow side pump. In the present teachings, the impeller that forms the upper flow side pump and the impeller that forms the lower flow side pump can be formed separately. This type of fuel pump 140 will be described with reference to FIGS. 6 to 8.

The fuel pump 140 also comprises a motor portion 170 and a pump portion 100. The motor portion 170 of the fuel pump 140 can be configured identically to the motor portion 70 of the fuel pump 10 of the first embodiment. As a result, a description of the motor portion 170 of the fuel pump 140 is omitted.

A pump portion 100 comprises a casing 110, impellers 120 and 130. The impellers 120 and 130 are substantially disc shaped. The impeller 120 is smaller in diameter than the impeller 130, and is disposed at the upper flow side (a lower side in FIG. 6) of the impeller 130. Furthermore, the impeller 120 and the impeller 130 are disposed coaxially.

A group of concavities 120*a* that is formed continuously in the circumferential direction is disposed in a ring shape along an outer peripheral portion of an intake side face (i.e., a lower face in FIG. 6) of the impeller 120. A group of concavities is not formed in a discharge side face (i.e., an upper face in FIG. 6) of the impeller 120. An engaging hole 120*b*, that is substantially D-shaped in cross-section across a plane perpendicular to the rotational axis, passes through a central portion of the impeller 120 in the direction of the thickness thereof. The shaft 78 engages with the engaging hole 120*b*.

A group of concavities 130*a* that is formed continuously in the circumferential direction is disposed in a ring shape along an outer peripheral portion of the intake side face (i.e., a lower face in FIG. 6) of the impeller 130. A group of concavities 130*b* that is formed continuously in the circumferential direction is disposed in a ring shape along an outer peripheral portion of the discharge side face (i.e., an upper face in FIG. 6) of the impeller 130 in a position corresponding to the group of concavities 130*a*. Each concavity of the group of concavities 130*a* and each concavity of the group of concavities 130*b* communicates via a communicating hole (not shown). An engaging hole 130*c*, that is substantially D-shaped in cross-section across a plane perpendicular to the rotational axis, passes through a central portion of the impeller 130 in the direction of the thickness thereof. The shaft 78 engages with the engaging hole 130*c*.

The casing 110 comprises a pump cover 111 and a pump body 112. A recess 111*a* is formed in the pump cover 111. The recess 111*a* has approximately the same diameter and approximately the same depth as the thickness of the impeller 130. The impeller 130 is rotatably inserted into the recess 111*a*. An extremely small clearance is formed between the outer peripheral face 130*d* of the impeller 130 and the side face 111*b* of the recess 111*a*. This clearance is provided to allow the impeller 130 to rotate smoothly.

A recess 112*a* is formed in the pump body 112. The recess 112*a* has approximately the same diameter and approximately the same depth as the thickness of the impeller 120. The impeller 120 is rotatably inserted into the recess 112*a*. A recess 112*d* that has a smaller diameter than the recess 112*a* is formed in the central portion of the recess 112*a*. A thrust bearing 133 that receives the thrust load of the shaft 78 is disposed in a lower face of the recess 112*d*. An extremely small clearance is also formed between the outer peripheral face 120*d* of the impeller 120 and the side face 112*b* of the recess 112*a*. This clearance is provided to allow the impeller 120 to rotate smoothly.

The casing 110 (i.e., the pump cover 111 and the pump body 112), with the impeller 130 installed in the recess 111*a* of the pump cover 111 and the impeller 120 installed in the recess 112*a* of the pump body 112, is fixed to a housing 160.

Figure 7:
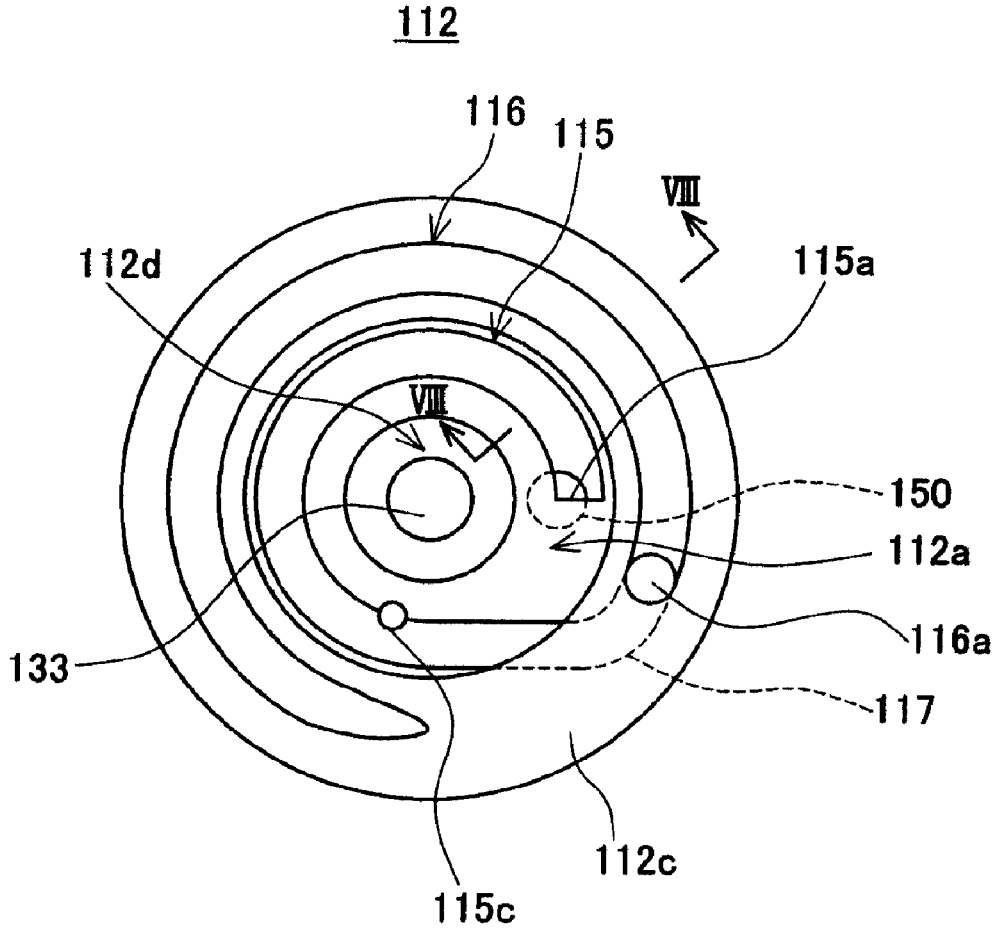
FIG. 7 is a plan view of a pump body of the pump portion shown in FIG. 6 seen from the discharge side.
Figure 8:
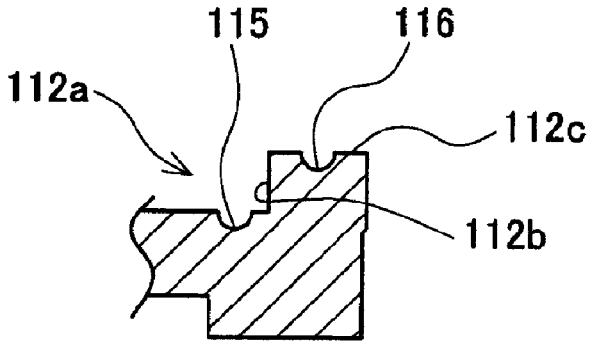
FIG. 8 is a cross-sectional view along the line VIII-VIII of FIG. 7.

FIG. 7 is a plan view seen from the discharge side of the pump body 112 viewed from the impeller 120 side (i.e. from the upper side in FIG. 7), and FIG. 8 is a cross-sectional view along the line VIII-VIII of FIG. 7. A groove 115 extending in a circumferential direction is formed in the bottom face of the recess 112*a* of the pump body 112 in an area facing the group of concavities 120*a*. A vapor jet 115*c* that passes through the pump body 112 in the up-down direction is formed within the groove 115. The function of the vapor jet 115*c* is to remove vapor. A groove 116 is formed in the face 112*c* of the pump body 112 that faces the impeller 120. The groove 116 extends in a circumferential direction in an area facing the group of concavities 130*a*. An intake hole 150 is formed at an upper flow end 115*a* of the groove 115. A lower flow end 115*b* of the groove 115 and an upper flow end 116*a* of the groove 116 communicate via a communicating passage 117 formed in the pump body 112.

A groove 118 is formed in a bottom face of the recess 111*a* of the pump cover 111. The groove 118 extends in a circumferential direction in an area facing the group of concavities 130*b*. An upper flow end of the groove 118 is located at a position corresponding to the upper flow end 116*a* of the groove 116. A discharge hole 151 is connected to a lower flow end of the groove 118. The discharge hole 151 joins the groove 118 with the exterior of the casing 110 (i.e., the interior of the motor portion).

In the fuel pump 140, when the shaft 178 of the motor portion 170 is driven causing it to rotate, the impellers 120 and 130 rotate. When the impeller 120 rotates, fuel within the fuel tank (not shown) is drawn in through the intake hole 150 into the upper flow end 115*a* of the groove 115. The fuel that has been drawn into the groove 115 flows from the upper flow end 115*a* toward the lower flow end 115*b* of the groove 115. The fuel that has increased in pressure in the groove 115 flows through the communicating passage 117 into the upper flow end 116*a* of the groove 116. The fuel that has flowed into the upper flow end 116*a* of the groove 116 is led to the groups of concavities 130*a* and 130*b* of the impeller 130 and to the groove 118. The fuel that has been led to the groups of concavities 130*a* and 130*b* of the impeller 130 and into the groove 116 and 118 increases in pressure in conjunction with the rotation of the impeller 130, and is discharged to the motor portion from the discharge hole 151.

In the fuel pump 50, as well, the upper flow side impeller 120 at the intake side is narrower in diameter than the lower flow side impeller 130. Furthermore, the impeller 120 only has a group of concavities 120*a* formed in the intake side face thereof. As a result, a case where a large amount of fuel is abruptly drawn into the casing 110 is prevented, and an abrupt change in the pressure of the fuel is prevented. The formation of vapor within the fuel can consequently be reduced.

Finally, although the preferred representative embodiments have been described in detail, the present embodiments are for illustrative purpose only and are not restrictive. It is to be understood that various changes and modifications may be made without departing from the spirit or scope of the appended claims. In addition, the additional features and aspects disclosed herein may also be utilized singularly or in combination with the above aspects and features.

What is claimed is:

1. A fuel pump comprising a casing and a substantially disc-shaped impeller rotating within the casing, wherein a first group of concavities and a second group of concavities are formed in a concentric pattern in an intake side face of the impeller, and the second group of concavities is located outside of the first group of concavities in a radial direction, a third group of concavities is formed in a discharge side face of the impeller, and the third group of concavities communicates with the second group of concavities, a first groove, a second groove and a communicating groove are formed in an inner face of the casing facing the intake side face of the impeller, the first groove extending continuously in a direction of rotation of the impeller from an upper flow end to a lower flow end in an area facing the first group of concavities, the second groove extending continuously in the direction of rotation of the impeller from an upper flow end to a lower flow end in an area facing the second group of concavities, and the communicating groove communicating with the lower flow end of the first groove and with the upper flow end of the second groove, and a third groove is formed in an inner face of the casing facing the discharge side face of the impeller, the third groove extending continuously in the direction of rotation of the impeller from an upper flow end to a lower flow end in an area facing the third group of concavities, wherein no group of concavities communicating with the first group of concavities is formed in the discharge side face of the impeller, and wherein the first group of concavities does not pass through from the intake side face to the discharge side face of the impeller.

2. A fuel pump as set forth in claim 1, wherein an escape groove is formed in an inner face of the casing facing the discharge side face of the impeller, a first end of the escape groove facing the lower flow end of the first groove, a second end of the escape groove being connected to the upper flow end of the third groove, and the escape groove extending in a manner corresponding to the communicating groove.

3. A fuel pump as set forth in claim 2, wherein a cross-sectional area of the escape groove gradually expands as it proceeds from the first end to the second end.

4. A fuel pump as set forth in claim 3, wherein a cross-sectional area of the communicating groove gradually contracts as it proceeds from the lower flow end of the first groove to the upper flow end of the second groove.

5. A fuel pump as set forth in claim 1, wherein a vapor jet is formed in the casing, the vapor jet extending from the first groove and/or the communicating groove to the exterior of the casing.

6. A fuel pump comprising:

a casing, a first impeller rotatably disposed within the casing, and a second impeller rotatably disposed within the casing, wherein a first group of concavities is formed in only an intake side face of the first impeller, the first group of concavities is formed in an area located a first distance away from a rotational axis of the first impeller in a radial direction, a second group of concavities is formed in an intake side face of the second impeller, a third group of concavities is formed in a discharge side face of the second impeller, the second group of concavities communicates with the third group of concavities, and the second and third group of concavities are formed in an area located a second distance away from a rotational axis of the second impeller in a radial direction, the second distance being longer than the first distance, a first groove is formed in an inner face of the casing facing the intake side face of the impeller, the first groove extending continuously from an upper flow end to a lower flow end in an area facing the first group of concavities, a second groove is formed in an inner face of the casing facing the intake side face of the impeller, the second groove extending continuously from an upper flow end to a lower flow end in an area facing the second group of concavities, a third groove is formed in an inner face of the casing facing the discharge side face of the impeller, the third groove extending continuously from an upper flow end to a lower flow end in an area facing the third group of concavities, and a communicating passage is formed in the casing, the communicating passage communicating with the lower flow end of the first groove and with the upper flow end of the second groove.

7. A fuel pump comprising a casing and a substantially disc-shaped impeller rotating within the casing, wherein:

a first group of concavities and a second group of concavities are formed in a concentric pattern in an intake side face of the impeller, and the second group of concavities is located outside of the first group of concavities in a radial direction, a third group of concavities is formed in a discharge side face of the impeller, and the third group of concavities communicates with the second group of concavities, a first groove, a second groove and a communicating groove are formed in an inner face of the casing facing the intake side face of the impeller, the first groove extending continuously in a direction of rotation of the impeller from an upper flow end to a lower flow end in an area facing the first group of concavities, the second groove extending continuously in the direction of rotation of the impeller from an upper flow end to a lower flow end in an area facing the second group of concavities, and the communicating groove communicating with the lower flow end of the first groove and with the upper flow end of the second groove, a third groove is formed in an inner face of the casing facing the discharge side face of the impeller, the third groove extending continuously in the direction of rotation of the impeller from an upper flow end to a lower flow end in an area facing the third group of concavities, and a cross-sectional area of the communicating groove gradually contracts as it proceeds from the lower flow end of the first groove to the upper flow end of the second groove.

* * * * *